US007651205B2

(12) United States Patent
Hayashi

(10) Patent No.: US 7,651,205 B2
(45) Date of Patent: Jan. 26, 2010

(54) LIQUID DISCHARGING HEAD USING PIEZOELECTRIC ACTUATOR AND IMAGE FORMING APPARATUS USING THE LIQUID DISCHARGING HEAD

(75) Inventor: Keisuke Hayashi, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 187 days.

(21) Appl. No.: 11/948,002

(22) Filed: Nov. 30, 2007

(65) Prior Publication Data

US 2008/0143795 A1 Jun. 19, 2008

(30) Foreign Application Priority Data

Dec. 1, 2006 (JP) ..... 2006-325905
Oct. 12, 2007 (JP) ..... 2007-267027

(51) Int. Cl.
*B41J 2/045* (2006.01)
*B41J 2/14* (2006.01)
*B41J 2/05* (2006.01)

(52) U.S. Cl. ..... 347/71; 347/50; 347/58

(58) Field of Classification Search ..... 347/71–72, 347/68, 70

See application file for complete search history.

(56) References Cited

FOREIGN PATENT DOCUMENTS

JP 10-109410 4/1998
JP 11-348279 12/1999
JP 2002-225265 8/2002
JP 2006-175845 7/2006
JP 2007-76264 3/2007

OTHER PUBLICATIONS

U.S. Appl. No. 11/805,203, filed May 21, 2007.

*Primary Examiner*—Matthew Luu
*Assistant Examiner*—Lisa M Solomon
(74) *Attorney, Agent, or Firm*—Cooper & Dunham, LLP

(57) ABSTRACT

A liquid discharging head includes a piezoelectric actuator including a plurality of piezoelectric elements and a plurality of electric supply members. The plurality of piezoelectric elements is provided in a row and includes an even number of piezoelectric element columns provided via a groove at a predetermined pitch. The plurality of electric supply members supplies electricity to the plurality of piezoelectric elements and includes electrodes disposed for the alternate piezoelectric element columns of the respective piezoelectric elements. One end of the electric supply member is positioned outwardly from an outer end of an endmost driven piezoelectric element column to which the electrode is connected, while another end of the electric supply member is positioned inwardly from an outer end of an endmost non-driven piezoelectric element column to which the electrode is not connected, in a manner that adjacent electric supply members do not overlap.

7 Claims, 13 Drawing Sheets

LIQUID DISCHARGING HEAD USING PIEZOELECTRIC ACTUATOR AND IMAGE FORMING APPARATUS USING THE LIQUID DISCHARGING HEAD

BACKGROUND

1. Technical Field

The present specification describes a liquid discharging head using a piezoelectric actuator and an image forming apparatus using the liquid discharging head, and more particularly, a liquid discharging head using a piezoelectric actuator and an image forming apparatus using the liquid discharging head for discharging liquid onto a recording medium to form an image on the recording medium.

2. Discussion of the Background

An image forming apparatus, such as a copying machine, a facsimile machine, a printer, or a multifunction printer having two or more of copying, printing, scanning, and facsimile functions, forms an image on a medium (e.g., a sheet) by using a liquid discharging method. In the liquid discharging method, a liquid discharging device includes a liquid discharging head (e.g., a recording head) for discharging liquid (e.g., an ink drop) onto a conveyed sheet. The liquid is adhered to the sheet to form an image on the sheet.

A known liquid discharging head is a piezoelectric type head using a piezoelectric actuator including a piezoelectric element. The piezoelectric element functions as a pressure generator or an actuator for generating pressure to compress liquid in a liquid chamber.

In one example of a related art liquid discharging head including the piezoelectric element, non-driven piezoelectric element columns are disposed on both ends of a piezoelectric element. An FPC (flexible printed circuit) having a width smaller than a width of the piezoelectric element is connected to the piezoelectric element.

Another example of the related art liquid discharging head includes a long head in which a plurality of piezoelectric element columns is groove-processed to form a piezoelectric element. A plurality of piezoelectric elements is disposed on a single base in a direction in which the plurality of piezoelectric element columns is aligned.

Higher printing speed is requested for the image forming apparatus (e.g., an ink-jet recording device) including the liquid discharging head. To increase printing speed, either liquid discharge frequency or a number of nozzles may be increased. In order to increase the liquid discharge frequency, a powerful motor needs to be controlled with increased precision to move a carriage for carrying the liquid discharging head at an increased speed. Further, the liquid discharging head needs to stably discharge liquid at an increased frequency. Therefore, the liquid discharging head may be a long head including the increased number of nozzles for discharging a liquid drop.

In such a long liquid discharging head, a plurality of piezoelectric elements, in each of which a plurality of piezoelectric element columns is disposed, is aligned. The plurality of piezoelectric element columns includes driven and non-driven piezoelectric element columns alternately provided. When the non-driven piezoelectric element columns are provided on both ends of the piezoelectric element, the non-driven piezoelectric element columns are adjacent to each other when the plurality of piezoelectric elements are aligned, resulting in varied nozzle pitches. To address this problem, another type of piezoelectric element, in which the driven piezoelectric element columns are provided on both ends of the piezoelectric element, is needed, resulting in increased manufacturing costs.

When the plurality of piezoelectric elements is aligned and a single electric supply member supplies electricity to the driven piezoelectric element columns of the plurality of the piezoelectric elements, a contact failure may occur if there is a difference between positions of an electrode of the electric supply member and the driven piezoelectric element column. When a plurality of electric supply members is provided to address this problem, mutual interference between adjacent electric supply members may occur.

Further, when a single electric supply member is connected to a single piezoelectric element, as a width of the aligned piezoelectric elements is increased in a direction in which the piezoelectric elements are aligned a width of the aligned electric supply members is also increased, thereby causing a large margin of error due to accumulated size tolerance. As a result, positional deviation of the electrode and the piezoelectric element column may occur, resulting in contact failure.

SUMMARY

This patent specification describes a liquid discharging head. One example of a liquid discharging head includes a piezoelectric actuator including a plurality of piezoelectric elements and a plurality of electric supply members. The plurality of piezoelectric elements is provided in a row. The plurality of piezoelectric elements includes an even number of piezoelectric element columns provided via a groove at a predetermined pitch. The plurality of electric supply members is configured to supply electricity to the plurality of piezoelectric elements. The plurality of electric supply members includes electrodes disposed for the alternate piezoelectric element columns of the respective piezoelectric elements. One end of the electric supply member for an endmost driven piezoelectric element column to which the electrode is connected is positioned outwardly from an outer end of the driven piezoelectric element column in a direction in which the piezoelectric element columns are aligned, while another end of the electric supply member for an endmost non-driven piezoelectric element column to which the electrode is not connected is positioned inwardly from an outer end of the non-driven piezoelectric element column in the direction in which the piezoelectric element columns are aligned, in a manner that adjacent electric supply members do not overlap.

This patent specification describes a liquid discharging head. One example of a liquid discharging head includes a piezoelectric actuator including a plurality of piezoelectric elements and a plurality of electric supply members. The plurality of piezoelectric elements is provided in a row. The plurality of piezoelectric elements includes an even number of piezoelectric element columns provided via a groove at a predetermined pitch. The plurality of electric supply members is configured to supply electricity to the plurality of piezoelectric elements. The plurality of electric supply members includes electrodes disposed for the alternate piezoelectric element columns of the respective piezoelectric elements. A width of the electric supply member in a direction in which the piezoelectric element columns are aligned is smaller than a width of the piezoelectric element in the direction in which the piezoelectric element columns are aligned.

This patent specification further describes an image forming apparatus. One example of an image forming apparatus includes a liquid discharging head. The liquid discharging head is configured to discharge liquid. The liquid discharging head includes a piezoelectric actuator including a plurality of piezoelectric elements and a plurality of electric supply members. The plurality of piezoelectric elements is provided in a row. The plurality of piezoelectric elements includes an even number of piezoelectric element columns provided via a groove at a predetermined pitch. The plurality of electric supply members is configured to supply electricity to the plurality of piezoelectric elements. The plurality of electric supply members includes electrodes disposed for the alternate piezoelectric element columns of the respective piezoelectric elements. One end of the electric supply member for an endmost driven piezoelectric element column to which the electrode is connected is positioned outwardly from an outer end of the driven piezoelectric element column in a direction in which the piezoelectric element columns are aligned, while another end of the electric supply member for an endmost non-driven piezoelectric element column to which the electrode is not connected is positioned inwardly from an outer end of the non-driven piezoelectric element column in the direction in which the piezoelectric element columns are aligned, in a manner that adjacent electric supply members do not overlap.

BRIEF DESCRIPTION OF THE DRAWINGS

A more complete appreciation of the disclosure and many of the attendant advantages thereof will be readily obtained as the same become better understood by reference to the following detailed description when considered in connection with the accompanying drawings, wherein.

DETAILED DESCRIPTION OF THE EXEMPLARY EMBODIMENTS

Figure 1:
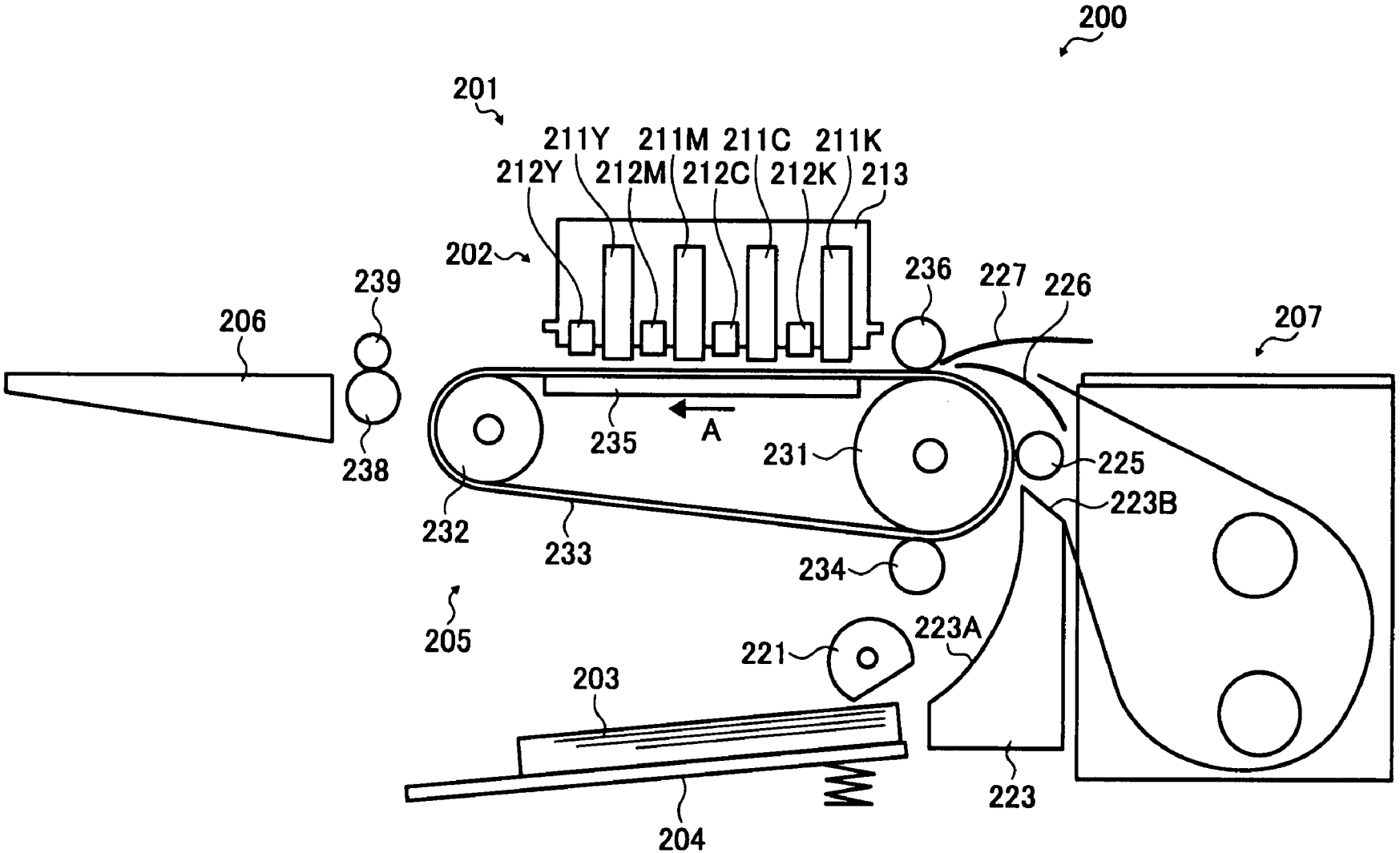
FIG. 1 is a schematic view of an image forming apparatus according to an exemplary embodiment.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, in particular to FIG. 1, an image forming apparatus 200 and its manner of operation according to an exemplary embodiment are described in order to provide a context within which to understand also the unique features of a piezoelectric actuator, a liquid discharging head using the piezoelectric actuator, and a liquid discharging device of the present invention.

FIG. 1 is a schematic view of the image forming apparatus 200. The image forming apparatus 200 includes a body 201, an output tray 206, and a duplex unit 207. The body 201 includes an image forming device 202, a paper tray 204, a conveying mechanism 205, a feed roller 221, a conveying guide 223, a registration roller 225, guides 226 and 227, a discharge roller 238, and a counter roller 239. The image forming device 202 includes full-line type recording heads 211K, 211C, 211M and 211Y, maintenance-recovery mechanisms 212K, 212C, 212M and 212Y, and a head holder 213. The conveying mechanism 205 includes a conveying roller 231, serving as a drive roller, a driven roller 232, a conveying belt 233, a charging roller 234, a platen 235, and a pressing roller 236. The conveying guide 223 includes guide surfaces 223A and 223B.

The paper tray 204 is provided in a lower portion of the body 201 and may stack a recording medium (e.g., a plurality of sheets 203), which may be, but is not limited to, paper. After the sheet 203 is fed from the paper tray 204, the conveying mechanism 205 conveys the sheet 203 on which the image forming device 202 forms a desired image and discharges the sheet 203 to the output tray 206 attached to a side of the body 201.

The duplex unit 207 is attachable to and detachable from the body 201. In duplex printing, after printing on one side (e.g., front side) is finished, the conveying mechanism 205 conveys the sheet 203 backwards into the duplex unit 207. The duplex unit 207 reverses the sheet 203 so that the image forming device 202 prints an image on another side (e.g., back side), and again feeds the reversed sheet 203 to the conveying mechanism 205. After another side (e.g., back side) printing is finished, the sheet 203 is discharged to the output tray 206.

Each of the recording heads 211K, 211C, 211M, and 211Y, serving as a liquid discharging head, discharges liquid drops in black, cyan, magenta, and yellow colors, for example, and is attached to the head holder 213 with a nozzle surface on which a nozzle for discharging the liquid drop is formed facing downwards.

The maintenance-recovery mechanisms 212K, 212C, 212M, and 212Y maintain and recover performance of the corresponding recording heads 211K, 211C, 211M, and 211Y, respectively. In head performance maintenance operation such as purge processing, wiping processing, and the like, the recording heads 211K, 211C, 211M, and 211Y and the maintenance-recovery mechanisms 212K, 212C, 212M, and 212Y are relatively moved, respectively, so as to have capping members, not shown, and the like, forming the maintenance-recovery mechanisms 212K, 212C, 212M, and 212Y, oppose the nozzle surfaces of the recording heads 211K, 211C, 211M, and 211Y.

Although the recording heads 211K, 211C, 211M, and 211Y are arranged in this order in a sheet conveyance direction A, and discharge black, cyan, magenta, and yellow liquid drops, respectively, the arrangement and the number of colors are not limited thereto. Further, in the line type recording heads 211K, 211C, 211M, and 211Y, serving as liquid discharging heads, a plurality of rows of nozzles for discharging the liquid drops in the respective colors may be provided at predetermined intervals. Alternatively, the image forming device 202 may include a single recording head in which a plurality of rows of nozzles for discharging a liquid drop is provided at predetermined intervals. Further, the recording heads 211K, 211C, 211M, and 211Y may be integrated with or separated from a liquid cartridge, not shown, for supplying the recording heads 211K, 211C, 211M, and 211Y with liquid.

The conveying belt 233 has an endless belt-like shape and is looped over the conveying roller 231 and the driven roller 232. The charging roller 234 charges a surface of the conveying belt 233. The platen 235 is provided opposite the image forming device 202 via the conveying belt 233, and maintains flatness of the conveying belt 233. The pressing roller 236 presses the sheet 203 conveyed on the conveying belt 233 against the conveying roller 231. A cleaning roller, not shown, includes a porous body and removes liquid (e.g., ink) adhered to the conveying belt 233.

The feed roller 221 has a half-moon-like shape. The feed roller 221 and a separating pad, not shown, separately feed the sheets 203 stacked on top of each other on the paper tray 204. The sheet 203 is fed between the registration roller 225 and the conveying belt 233 along the guide surface 223A, and is guided by the guide 226 to the conveying belt 233 of the conveying mechanism 205 at a preset time.

The guide surface 223B guides the sheet 203 fed from the duplex unit 207. The guide 227 guides the sheet 203 returned from the conveying mechanism 205 toward the duplex unit 207 in duplex printing.

The discharge roller 238 and the counter roller 239 are provided downstream from the conveying mechanism 205 in the sheet conveyance direction, and feed the sheet 203 bearing the image to the output tray 206.

In the image forming apparatus 200, the conveying belt 233 rotates in the direction A and is charged positively by contacting the charging roller 234 supplied with a high voltage. The conveying belt 233 is charged at a predetermined pitch by switching a polarity of the voltage of the charging roller 234 at predetermined intervals.

When the sheet 203 is fed onto the conveying belt 233 the sheet 203 is polarized. A surface of the sheet 203 contacting the conveying belt 233 is charged with a polarity opposite that of a surface of the conveying belt 233, and thus the conveying belt 233 and the sheet 203 are electrostatically attracted to each other so that the sheet 203 is electrostatically attracted to the conveying belt 233, giving the sheet 203 on the conveying belt 233 a flat surface without warping or irregularities.

When the conveying belt 233 rotates to move the sheet 203, the recording heads 211K, 211C, 211M, and 211Y discharge the liquid drops to form a desired image on the sheet 203 and the sheet 203 bearing the image is discharged to the output tray 206 by the discharge roller 238.

Figure 2:
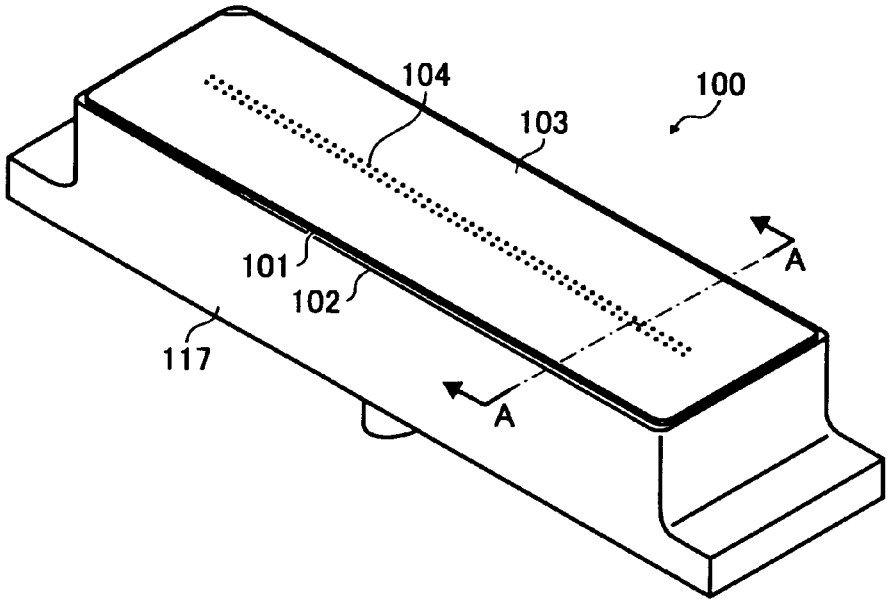
FIG. 2 is an external perspective view of a liquid discharging head included in the image forming apparatus shown in FIG. 1.
Figure 3:
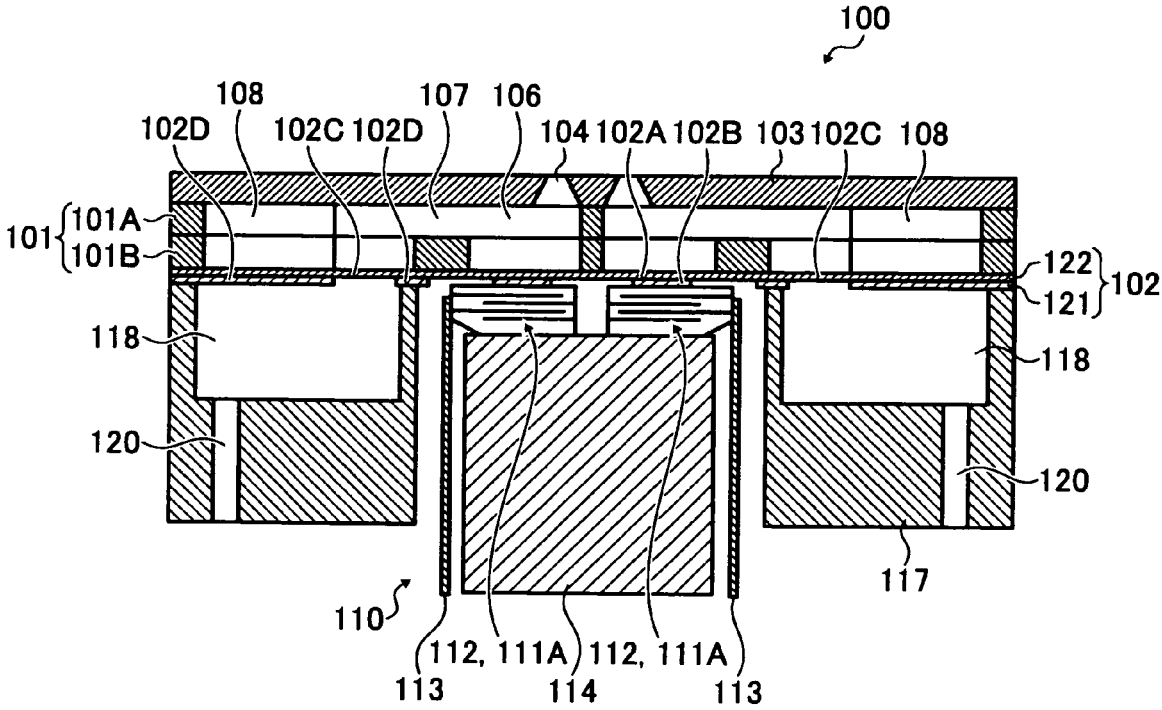
FIG. 3 is a sectional view of the liquid discharging head as taken along line A-A of FIG. 2.
Figure 4:
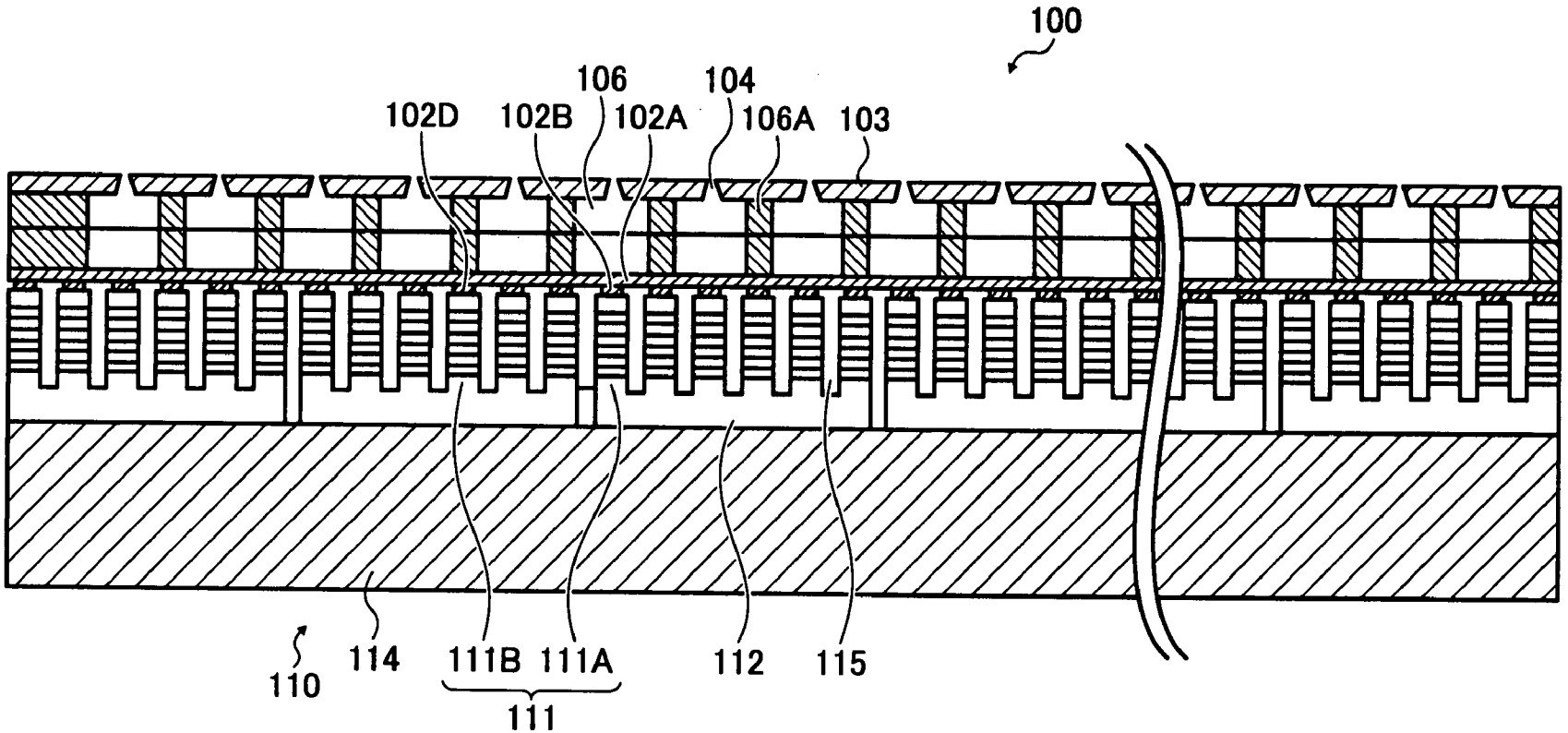
FIG. 4 is a sectional view of the liquid discharging head in a direction perpendicular to line A-A of FIG. 2.

Referring to FIGS. 2 through 4, the following describes a liquid discharging head 100 according to an exemplary embodiment. The liquid discharging head 100 may be the recording heads 211K, 211C, 211M and 211Y included in the image forming apparatus 200 depicted in FIG. 1.

FIG. 2 is an external perspective view of the liquid discharging head 100. As illustrated in FIG. 2, the liquid discharging head 100 includes a base plate 101, a vibration plate 102, a nozzle plate 103, a nozzle 104, and a frame 117.

The base plate 101 (e.g., a liquid chamber plate) includes a SUS plate. The vibration plate 102 is attached to a bottom surface of the base plate 101. The nozzle plate 103 is attached to a top surface of the base plate 101. The nozzle 104 is provided on the nozzle plate 103 and discharges a liquid drop. The frame 117 is adhered around the vibration plate 102 with an adhesive.

FIG. 3 is a sectional view of the liquid discharging head 100 along a line A-A shown in FIG. 2. As illustrated in FIG. 3, the liquid discharging head 100 further includes a liquid compression chamber 106, a fluid resistance portion 107, a shared liquid chamber 108, a piezoelectric actuator 110, a diaphragm 102C, a buffer chamber 118, and a connecting route 120. The base plate 101 includes a restrictor plate 101A and a chamber plate 101. The vibration plate 102 includes a metal member 121 and a resin member 122. The metal member 121 includes an island protrusion 102B and a thick portion 102D. The resin member 122 includes a vibration plate area 102A. The piezoelectric actuator 110 includes a piezoelectric element 112, a electric supply member 113, and a base 114.

The base plate 101, the vibration plate 102, and the nozzle plate 103 form the liquid compression chamber 106 (e.g., a pressure chamber, a pressurizing chamber, or a flow channel), the fluid resistance portion 107, and the shared liquid chamber 108. The nozzle 104 is connected to the liquid compression chamber 106. The fluid resistance portion 107 supplies liquid to the liquid compression chamber 106. The shared liquid chamber 108 supplies liquid to a plurality of liquid compression chambers 106. A liquid tank, not shown, supplies liquid to the shared liquid chamber 108 via a supply route, not shown.

The restrictor plate 101A and the chamber plate 101B are attached to each other to form the base plate 101. In the base plate 101, the SUS plate is etched with an acid etching liquid or is mechanically processed (e.g., stamped) to form openings such as the liquid compression chamber 106, the fluid resistance portion 107, and the shared liquid chamber 108. For example, the fluid resistance portion 107 is formed by forming an opening in a part of the restrictor plate 101A and not forming an opening in a part of the chamber plate 101B.

The vibration plate 102 is attached to the chamber plate 101B forming the base plate 101. The resin member 122 is directly coated on the metal member 121 to form the vibration plate 102. The metal member 121 includes a SUS base plate. A resin prepared to have a greater linear expansion coefficient than the metal member 121 is directly applied on the metal member 121, and is heated and solidified to form the resin member 122 (e.g., a resin layer). The vibration plate area 102A is included in the resin member 122, and forms a deformable wall of the liquid compression chamber 106. The island protrusion 102B (e.g., an island convex) is included in the metal member 121, and is provided opposite the liquid compression chamber 106 via the vibration plate area 102A. Alternatively, the vibration plate 102 may be formed of a resin layer and a metal adhered to each other with an adhesive, or may be electroformed with nickel.

FIG. 4 is a sectional view of the liquid discharging head 100 in a direction perpendicular to line A-A of FIG. 2. The line perpendicular to line A-A corresponds to a direction in which the liquid compression chambers 106 are arranged or to a direction perpendicular to a longitudinal direction of the liquid compression chamber 106. As illustrated in FIG. 4, the liquid discharging head 100 further includes a wall 106A. The piezoelectric element 112 includes piezoelectric element columns 111 and slit grooves 115. The piezoelectric element columns 111 include a driven piezoelectric element column 111A and a non-driven piezoelectric element column 111B.

The wall 106A is formed of the base plate 101. The thick portion 102D is formed of the metal member 121, and is provided at a position for the wall 106A.

The nozzle plate 103 forms a plurality of nozzles 104 for a plurality of liquid compression chambers 106. The nozzle 104 has a diameter of from about 10 μm to about 30 μm. The nozzle plate 103 is adhered to the restrictor plate 101A depicted in FIG. 3 of the base plate 101 depicted in FIG. 3 with an adhesive. The nozzle plate 103 may include a metal (e.g., stainless steel, nickel, and/or the like), a resin (e.g., polyimide resin film), silicon, and a mixture of the above. A water-repellent film is formed on a discharging surface of the nozzle 104 by a known method such as plating or coating with a repellent so as to provide water repellency against ink.

As illustrated in FIGS. 3 and 4, the piezoelectric actuator 110 is provided under (e.g., on the opposite side of the liquid compression chamber 106) the vibration plate 102 via the island protrusion 102B. The piezoelectric actuator 110 includes a plurality of piezoelectric elements 112, a plurality of electric supply members 113, and the base 114. The plurality of piezoelectric elements 112 are arranged in line and attached to the base 114. The electric supply member 113 includes an FPC (flexible printed circuit) and supplies electricity to the piezoelectric element 112.

As illustrated in FIG. 4, the piezoelectric element 112 includes an even number of piezoelectric element columns 111 and slit grooves 115. The piezoelectric element 112 is half cut [MSOffice1] by groove or slit processing to form an even number of piezoelectric element columns 111 via the slit grooves 115 at a predetermined pitch. So, width of the slit groove 115 corresponds to a distance between adjacent piezoelectric element columns 111A and 111B of the piezoelectric element 112. The driven piezoelectric element column 111A is driven and the non-driven piezoelectric element column 111B is not driven. The driven piezoelectric element column 111A and the non-driven piezoelectric element column 111B are alternately disposed.

The electric supply member 113 depicted in FIG. 3 includes an electrode, not shown, provided for the driven piezoelectric element columns 111A of the piezoelectric element 112. Namely, the electrode is connected to the driven piezoelectric element column 111A and is not connected to the non-driven piezoelectric element column 1113. The electric supply member 113 includes an FPC. One end of the electric supply member 113 for an endmost driven piezoelectric element column 111A protrudes from the endmost driven piezoelectric element columns 111A in a direction in which the piezoelectric element columns 111 are aligned. Another end of the electric supply member 113 for an endmost non-driven piezoelectric element column 111B does not protrude from an endmost non-driven piezoelectric element column 111B in the direction in which the piezoelectric element columns 111 are aligned. For example, one end of the electric supply member 113 for the endmost driven piezoelectric element column 111A to which the electrode is connected is positioned outwardly from an outer end of the endmost driven piezoelectric element column 111A, while another end of the electric supply member 113 for the endmost non-driven piezoelectric element column 111B to which the electrode is not connected is positioned inwardly from an outer end of the endmost non-driven piezoelectric element column 111B. Therefore, adjacent electric supply members 113 do not overlap.

As illustrated in FIG. 4, the driven piezoelectric element column 111A of the piezoelectric actuator 110 is adhered to the island protrusion 102B of the vibration plate 102 (depicted in FIG. 3) with an adhesive, while the non-driven piezoelectric element column 111B is adhered to the thick portion 102D for the wall 106A with an adhesive.

In the piezoelectric element 112, a piezoelectric layer and an internal electrode layer are layered alternately. The piezoelectric layer has a thickness of from about 10 μm to about 50 μm each, and includes lead zirconate titanate (PZT). The internal electrode layer has a thickness of several micrometers each, and includes silver palladium (AgPd). The internal electrode layers are electrically connected to an individual electrode, not shown, and a shared electrode, not shown, alternately. The individual electrode and the shared electrode serve as end electrodes or external electrodes. The electric supply member 113 (depicted in FIG. 3) is soldered to the individual electrode and the shared electrode. The piezoelectric element 112 has a piezoelectric constant d33 indicating expansion and contraction in a direction perpendicular to a surface of the internal electrode or a thickness direction of the internal electrode. Expansion and contraction of the driven piezoelectric element column 111A of the piezoelectric element 112 displaces the vibration plate area 102A to expand and compress, respectively, the liquid compression chamber 106. When a driving signal is applied to charge the driven piezoelectric element column 111A of the piezoelectric element 112, the liquid compression chamber 106 expands, and when the driven piezoelectric element column 111A of the piezoelectric element 112 is discharged, the liquid compression chamber 106 contracts in a direction opposite to a direction in which the liquid compression chamber 106 expands.

According to this non-limiting exemplary embodiment, the piezoelectric element 112 is displaced in a direction d33 to compress ink in the liquid compression charter 106. Alternatively, however, the piezoelectric element 112 may be displaced in a direction d31.

The base 114 (depicted in FIGS. 3 and 4) may preferably include a metal material to prevent the piezoelectric element 112 from storing self-generated heat. When the base 114 has a large linear expansion coefficient, an adhesive for adhering the piezoelectric element 112 to the base 114 may peel off from an interface between the piezoelectric element 112 and the base 114 at very high or very low temperatures. Even so, when the piezoelectric element 112 is relatively short, the piezoelectric element 112 may not separate from the base 114 even when an environmental temperature changes. However, when the piezoelectric element 112 includes about 400 nozzles with a gap of about 300 dpi provided between adjacent piezoelectric elements 112, each piezoelectric element 112 has a length of from about 30 mm to about 40 mm or greater, which is no longer short. As a result, the piezoelectric element 112 may easily separate from the base 114. Therefore, the base 114 preferably includes a material having a linear expansion coefficient of about 10E-6/° C. or smaller. Specifically, when all parts adhered to the piezoelectric element 112 have a linear expansion coefficient of about 10E-6/° C. or smaller, separation of the piezoelectric element 112 from the base 114 can be effectively prevented. Accordingly, the parts adhered to the piezoelectric element 112 may include, for example, stainless steel plate.

As illustrated in FIG. 3, the frame 117 is adhered around the vibration plate 102 with an adhesive. The diaphragm 102C is formed of the resin member 122 of the vibration plate 102, and is deformable. The buffer chamber 118 is formed of the frame 117, and is provided adjacent to the shared liquid chamber 108 via the diaphragm 102C. The diaphragm 102C forms a wall of the shared liquid chamber 108 and the buffer chamber 118. Air enters or exits the buffer chamber 118 via the connecting route 120.

The liquid discharging head 100 includes two rows of the piezoelectric columns 111 of the piezoelectric elements 112 opposite each other so that a gap of about 300 dpi is provided between the piezoelectric columns 111 of the piezoelectric element 112. The liquid discharging head 100 includes two rows of the liquid compression chambers 106 and the nozzles 104 staggered so that a gap of about 150 dpi is provided between adjacent liquid compression chambers 106 and adjacent nozzles 104. Thus, the liquid discharging head 100 provides a resolution of about 300 dpi for a single scan.

As described above, most of the elements included in the liquid discharging head 100 include SUS. Thus, the elements included in the liquid discharging head 100 have a common thermal expansion coefficient, preventing or reducing problems caused by thermal expansion of the elements when the liquid discharging head 100 is manufactured or used.

In the above-described liquid discharging head 100, when a voltage applied to the driven piezoelectric element column 111A of the piezoelectric element 112 decreases from a reference electric potential, the driven piezoelectric element column 111A contracts to lower the vibration plate area 102A of the vibration plate 102. Accordingly, the volume of the liquid compression chamber 106 is increased, and ink is injected into the liquid compression chamber 106.

Conversely, when a voltage applied to the driven piezoelectric element column 111A increases to expand the driven piezoelectric element column 111A in a layered direction in which the metal member 121 and the resin member 122 are layered, the vibration plate area 102A is deformed, that is, pressed toward the nozzle 104. Accordingly, the volume of the liquid compression chamber 106 is decreased, compressing the ink in the liquid compression chamber 106. Thus, an ink drop is discharged (e.g., ejected) from the nozzle 104.

The voltage applied to the driven piezoelectric element column 111A changes back to the reference electric potential, and thus the vibration plate area 102A returns to the original position. When the volume of the liquid compression chamber 106 expands to generate a negative pressure, ink is injected from the shared liquid chamber 108 into the liquid compression chamber 106. After vibration of a meniscus surface of the nozzle 104 is damped and stabilized, a next liquid discharging operation starts.

A method for driving the liquid discharging head 100 is not limited to the above-described example for decreasing and increasing the volume of the liquid compression chamber 106. The volume of the liquid compression chamber 106 may be decreased and increased by changing application of a driving waveform. [MSOffice2]

As described above, since the liquid discharging head 100 includes the piezoelectric actuator 110 according to the above exemplary embodiment, a reliable head may be provided at a low cost. [MSOffice3]

Figure 5:
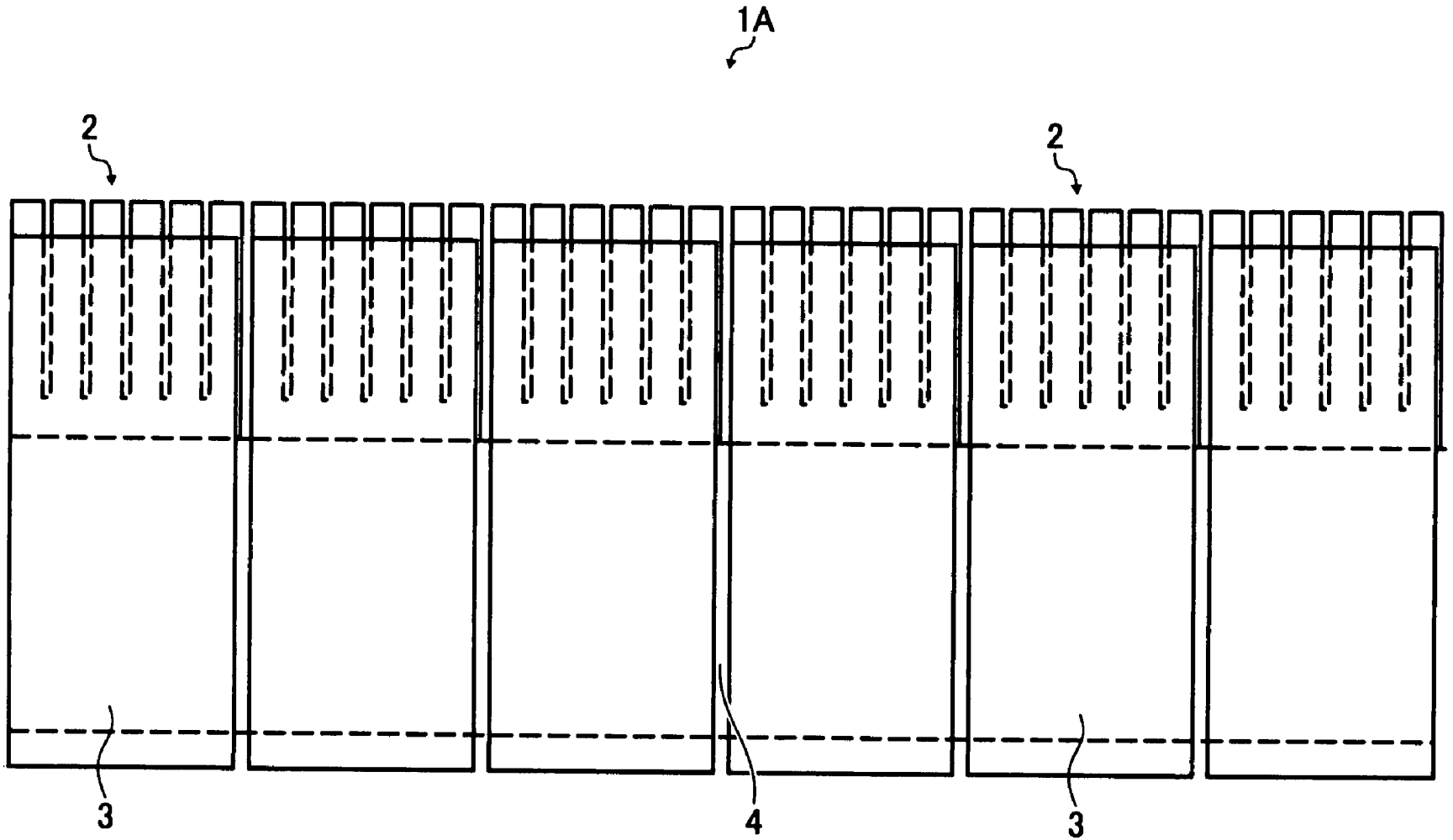
FIG. 5 is a schematic view of a piezoelectric actuator included in the liquid discharging head shown in FIG. 4.
Figure 6:
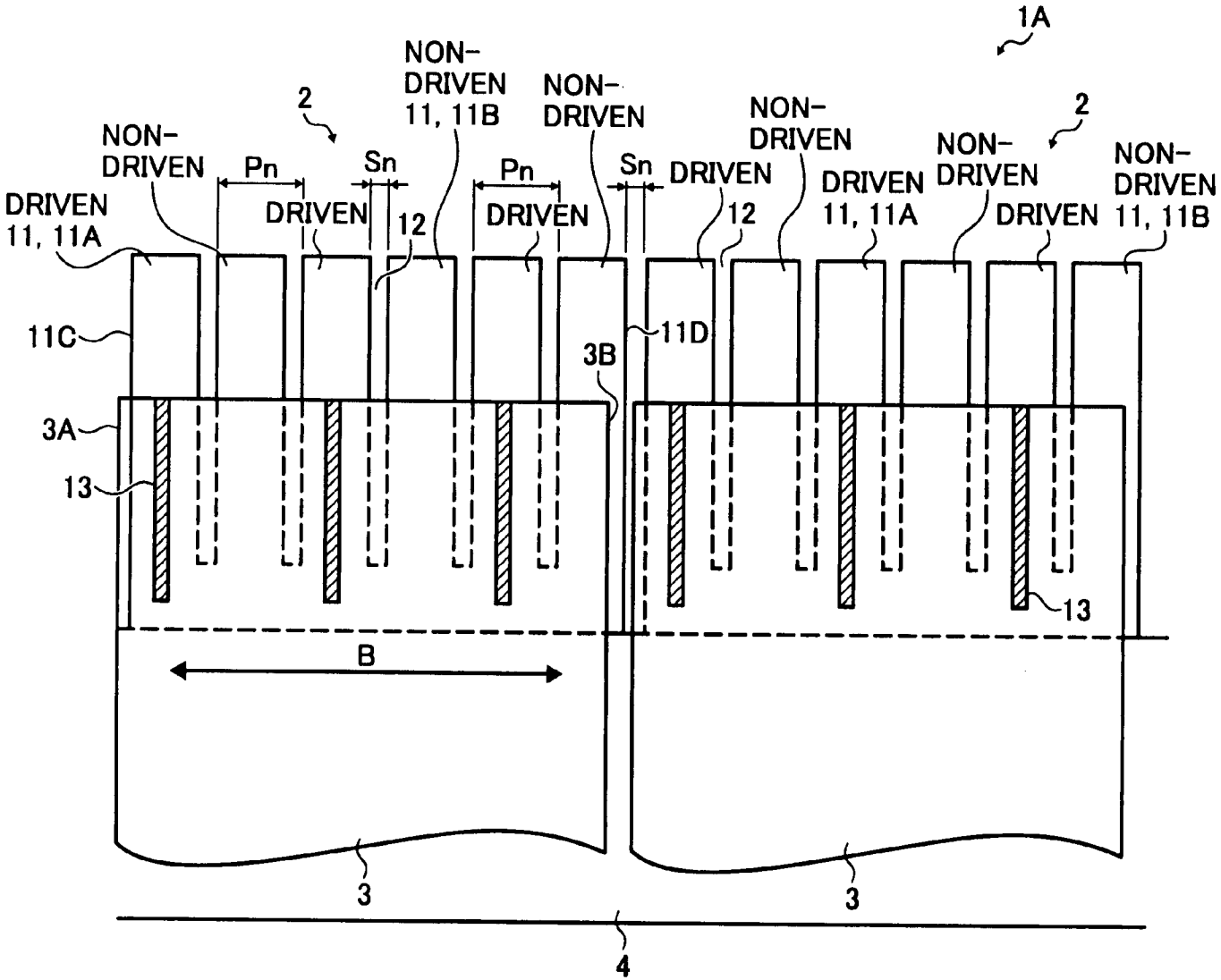
FIG. 6 is an enlarged view of the piezoelectric actuator shown in FIG. 5.

Referring to FIGS. 5 and 6, the following describes a piezoelectric actuator 1A according to an exemplary embodiment.

FIG. 5 is a schematic view of the piezoelectric actuator 1A. FIG. 6 is an enlarged view of the piezoelectric actuator 1A. As illustrated in FIG. 5, the piezoelectric actuator 1A includes piezoelectric elements 2, electric supply members 3, and a base 4. As illustrated in FIG. 6, the piezoelectric element 2 includes piezoelectric element columns 11 and slit grooves 12. The piezoelectric element columns 11 include a driven piezoelectric element column 11A and a non-driven piezoelectric element column 11B. The electric supply member 3 includes electrodes 13.

The piezoelectric actuator 1A, the piezoelectric element 2, the electric supply member 3, the base 4, the piezoelectric element columns 11, and the slit grooves 12 are equivalent to the piezoelectric actuator 110, the piezoelectric element 112, the electric supply member 113, the base 114, the piezoelectric element columns 111, and the slit grooves 115 (all of which are depicted in FIG. 3 or 4), respectively. The electric supply member 3 includes an FPC and supplies electricity to each of the piezoelectric elements 2. The plurality of piezoelectric elements 2 are arranged in a row and connected to the base 4.

The piezoelectric element 2 is half cut by groove or slit processing to form an even number of piezoelectric element columns 11 via slit grooves 12 having a groove width Sn at a predetermined pitch Pn. For example, a distance between two adjacent piezoelectric element columns 11 of the piezoelectric element 2 corresponds to the groove width Sn.

Figure 7:
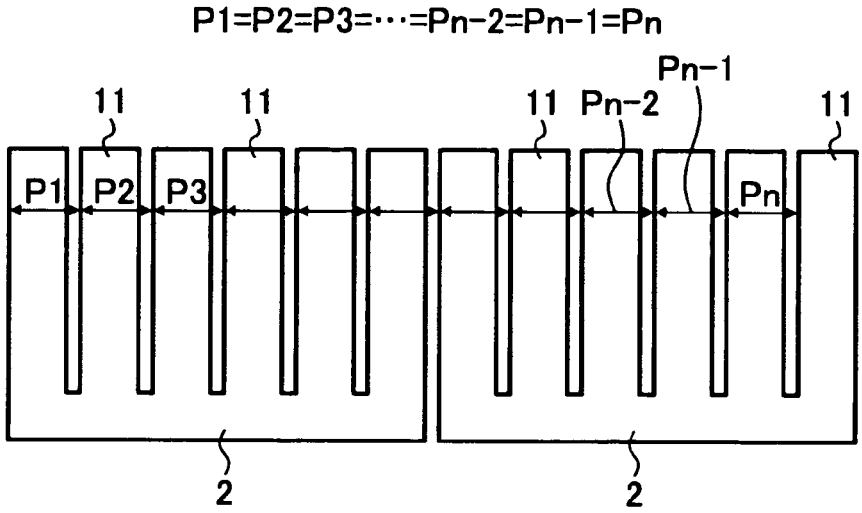
FIG. 7 is a schematic view of a piezoelectric element included in the piezoelectric actuator shown in FIG. 6.

FIG. 7 is a schematic view of the piezoelectric element 2. As illustrated in FIG. 7, two adjacent piezoelectric element columns 11 of the piezoelectric element 2 are arranged at the pitch Pn so that all the piezoelectric element columns 11 are arranged at the pitch Pn.

As illustrated in FIG. 6, the piezoelectric element columns 11 of the piezoelectric element 2 include a piezoelectric element column (e.g., the driven piezoelectric element column 11A) which is driven and a piezoelectric element column (e.g., the non-driven piezoelectric element column 11B) which is not driven. The driven piezoelectric element columns 11A and the non-driven piezoelectric element columns 11B are arranged alternately. Since the piezoelectric element 2 has an even number of the piezoelectric element columns 11, when a plurality of piezoelectric elements 2 is aligned, the non-driven piezoelectric element column 11B provided at an end of one of adjacent piezoelectric elements 2 is adjacent to the driven piezoelectric element column 11A provided at an end of another one of adjacent piezoelectric elements 2 in a direction B in which the plurality of piezoelectric element columns 11 are arranged.

The electric supply member 3 includes the electrodes 13. The electrode 13 is disposed for the alternate piezoelectric element column 11 of the piezoelectric element 2. The piezoelectric element column 11 having the electrode 13 serves as the driven piezoelectric element column 11A.

An end 3A of the electric supply member 3 for an endmost driven piezoelectric element column 11A to which the electrode 13 is connected is positioned outwardly from an outer end 11C of the driven piezoelectric element column 11A in the direction B in which the piezoelectric element columns 11 are aligned, while another end 3B of the electric supply member 3 for an endmost non-driven piezoelectric element column 118 to which the electrode 13 is not connected is positioned inwardly from an outer end 11D of the non-driven piezoelectric element column 11B. Therefore, adjacent electric supply members 3 do not overlap.

Figure 8:
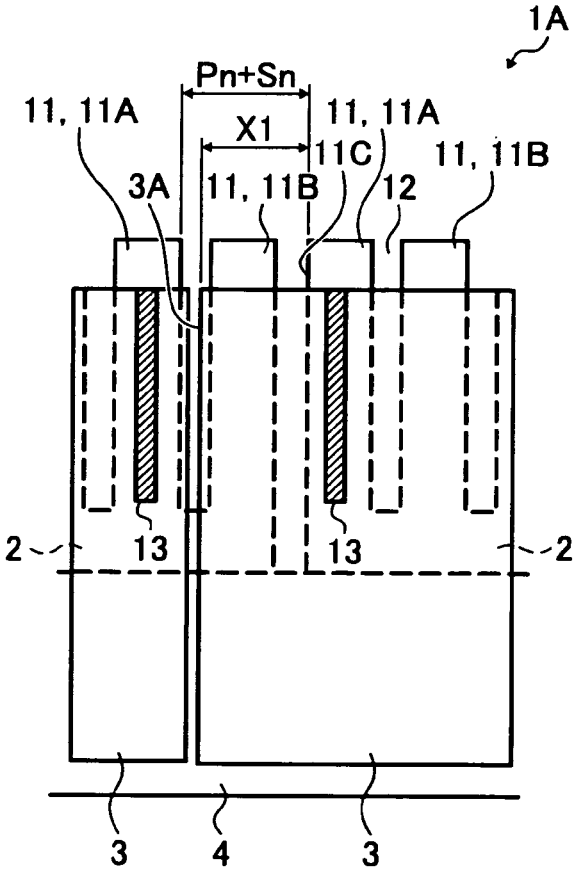
FIG. 8 illustrates an amount of deviation between an outer end of a piezoelectric element column and one end of a electric supply member included in the piezoelectric actuator shown in FIG. 6.
Figure 9:
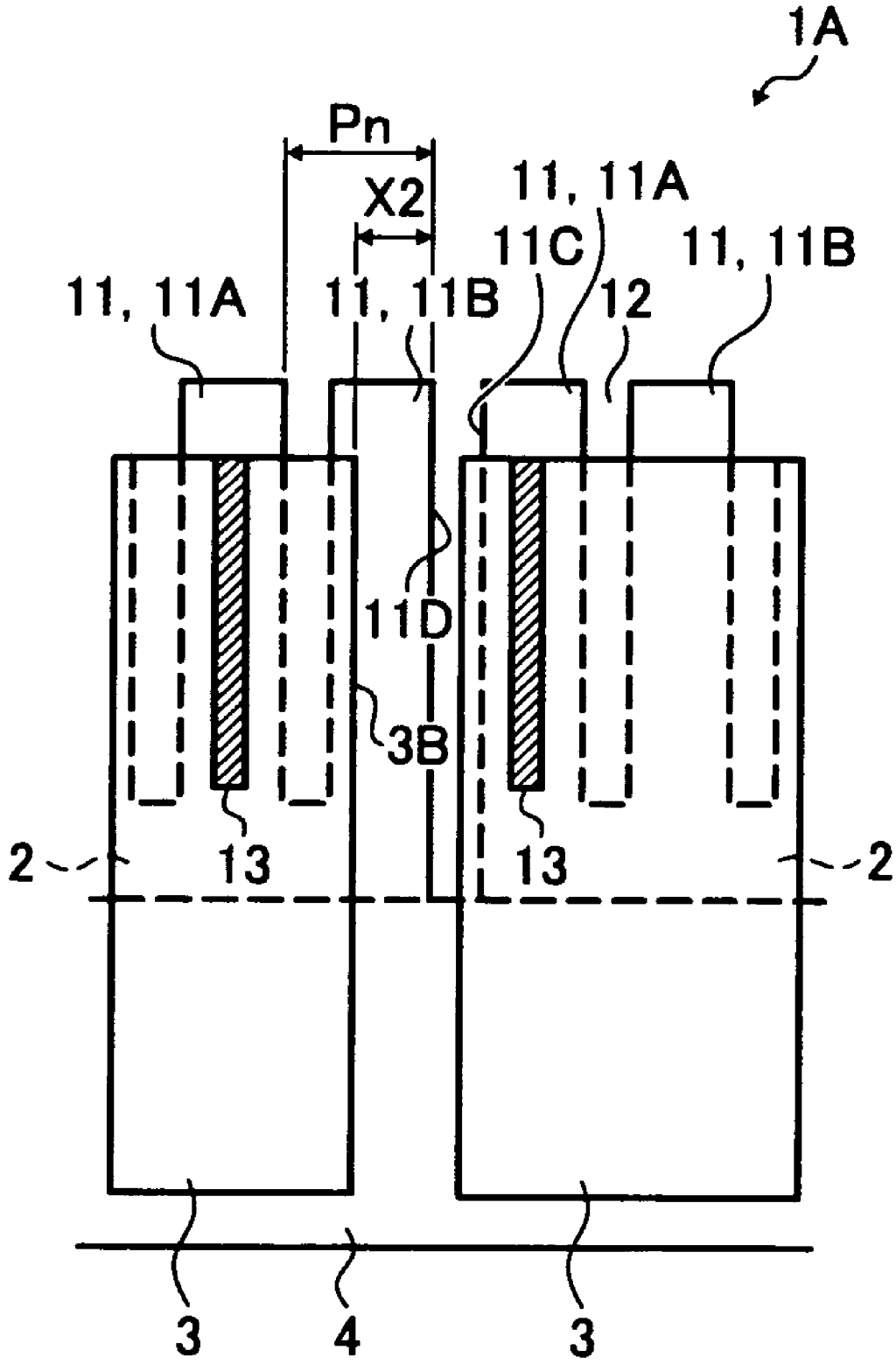
FIG. 9 illustrates an amount of deviation between another outer end of the piezoelectric element column and another end of the electric supply member included in the piezoelectric actuator shown in FIG. 6.

FIG. 8 illustrates an amount of deviation X1 between the end 3A of the electric supply member 3 and the outer end 11C of the endmost driven piezoelectric element column 11A. The amount of deviation X1 between the end 3A of the electric supply member 3 and the outer end 11C of the driven piezoelectric element column 11A is considered to be equal to or smaller than (one pitch+one groove width), that is, $X \leqq (Pn+S1)$. FIG. 9 illustrates an amount of deviation X2 between another end 3B of the electric supply member 3 and another outer end 11D of the endmost non-driven piezoelectric element column 11B. As illustrated in FIG. 9, the amount of deviation X2 between the end 3B of the electric supply member 3 and the outer end 11D of the non-driven piezoelectric element column 11B is considered to be one pitch or smaller, that is, X2≦Pn. Accordingly, the electric supply member 3 may have large outside dimension tolerance.

As illustrated in FIG. 6, since the piezoelectric element 2 includes an even number of the piezoelectric element columns 11, one of the endmost piezoelectric element columns 11 of the piezoelectric element 2 may be the driven piezoelectric element column 11A, while another one of the endmost piezoelectric element columns 11 of the piezoelectric element 2 may be the non-driven piezoelectric element column 11B. Thus, the piezoelectric elements 2, in which the driven piezoelectric element column 11A and the non-driven piezoelectric element column 11B are alternately disposed, may be arranged, resulting in cost reduction.

Further, since the plurality of electric supply members 3 supplies electricity to the driven piezoelectric element columns 11A of the respective piezoelectric elements 2, there is a decreased amount of deviation between positions of the electrode 13 of the electric supply member 3 and the driven piezoelectric element column 11A of the piezoelectric element 2, thereby preventing loose connection. Further, since the end 3A of the electric supply member 3 is positioned outwardly from the outer end 11C of the driven piezoelectric element column 11A in the direction B, while another end 3B of the electric supply member 3 is positioned inwardly from the outer end 11D of the non-driven piezoelectric element column 11B in the direction B, reciprocal interference between adjacent electric supply members 3 may be prevented, thereby improving reliability of the piezoelectric actuator 1A.

For example, a PZT (piezoelectric zirconate titanate) unit (e.g., piezoelectric element 2) including a PZT column (e.g., piezoelectric element column 11) including an even number of PZTs is fixed on the base 4 which is formed of metal and has a length of about 300 mm. The electrode 13 of the electric supply member 3 is connected to the alternate piezoelectric element column 11 of the piezoelectric element 2. The piezoelectric element column 11 has a width of about 50 μm, a pitch P1 of about 80 μm, and a groove width S1 of about 30 μm. The electric supply member 3 includes an FPC, and the piezoelectric element column 11 is soldered to the electrode 13.

The piezoelectric actuator 1A includes an even number of the piezoelectric element columns 11 provided via the slit grooves 12 at a predetermined pitch, the plurality of piezoelectric elements 2 disposed in a row, and the plurality of electric supply members 3 having the electrodes 13 disposed for the alternate piezoelectric element columns 11 of the respective piezoelectric elements 2. One end 3A of the electric supply member 3 for the endmost driven piezoelectric element column 11A to which the electrode 13 is connected is positioned outwardly from the outer end 11C of the driven piezoelectric element column 11A, while another end 3B of the electric supply member 3 for the endmost non-driven piezoelectric element column 11B to which the electrode 13 is not connected is positioned inwardly from the outer end 11D of the non-driven piezoelectric element column 11B in the direction B. In other words, one end 3A of the electric supply member 3 is positioned outwardly from the outer end 11C of the driven piezoelectric element column 11A to which the electrode 13 is connected in the direction B in which the piezoelectric element columns 11 are aligned, while another end 3B of the electric supply member 3 is positioned inwardly from the outer end 11D of the non-driven piezoelectric element column 11B to which the electrode 13 is not connected in the direction B. Accordingly, adjacent electric supply members 3 do not overlap. The piezoelectric actuator 1A includes one type of the piezoelectric element 2 in which the endmost piezoelectric element column 11 of the piezoelectric element 2 corresponds to the driven piezoelectric element column 11A, while another endmost piezoelectric element column 11 of the piezoelectric element 2 corresponds to the non-driven piezoelectric element column 11B. Namely, the driven piezoelectric element column 11A provided at an end of one of adjacent piezoelectric elements 2 is adjacent to the non-driven piezoelectric element column 11B provided at an end of another one of adjacent piezoelectric elements 2. Thus, the plurality of electric supply members 3 may be connected without interference. Therefore, the long, reliable piezoelectric actuator 1A may be obtained at a low cost.

Figure 10:
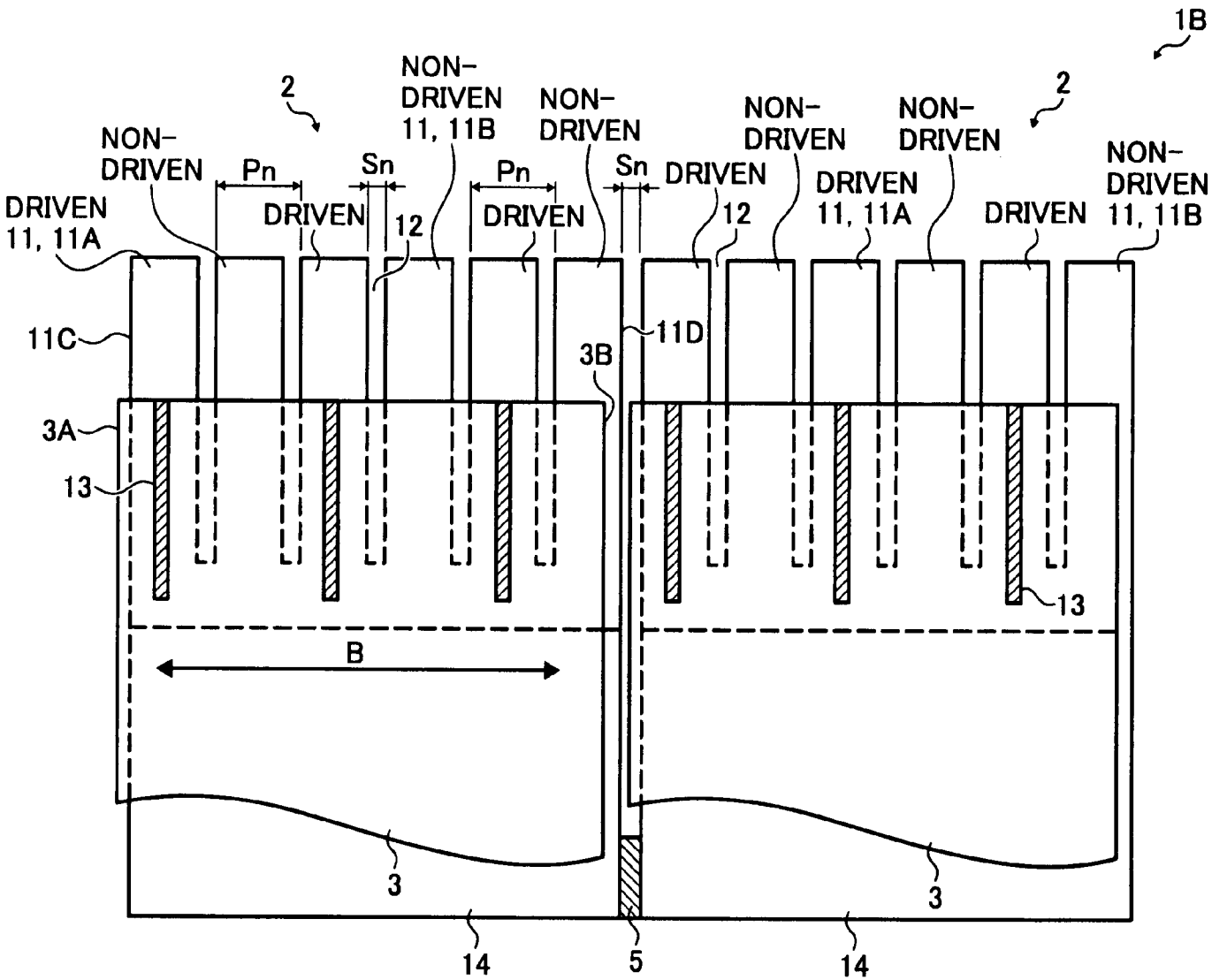
FIG. 10 is an enlarged view of a piezoelectric actuator according to another exemplary embodiment.

Referring to FIG. 10, the following describes a piezoelectric actuator 1B according to another exemplary embodiment. FIG. 10 is an enlarged view of the piezoelectric actuator 1B. The piezoelectric actuator 1B further includes a spacer 5. [MSOffice4]

The piezoelectric actuator 1B includes a plurality of bases 14 for holding the piezoelectric element 2. The spacer 5 has a predetermined width, and is provided between adjacent bases 14. The width of the spacer 5 is preferably identical to the groove width S1. The other elements of the piezoelectric actuator 1B are identical to the piezoelectric actuator 1A depicted in FIG. 6.

When one of the piezoelectric elements 2 has a failure on a production process such as manufacturing of the slit groove 12, and the like, the piezoelectric element 2 may be replaced together with the base 14.

Figure 11:
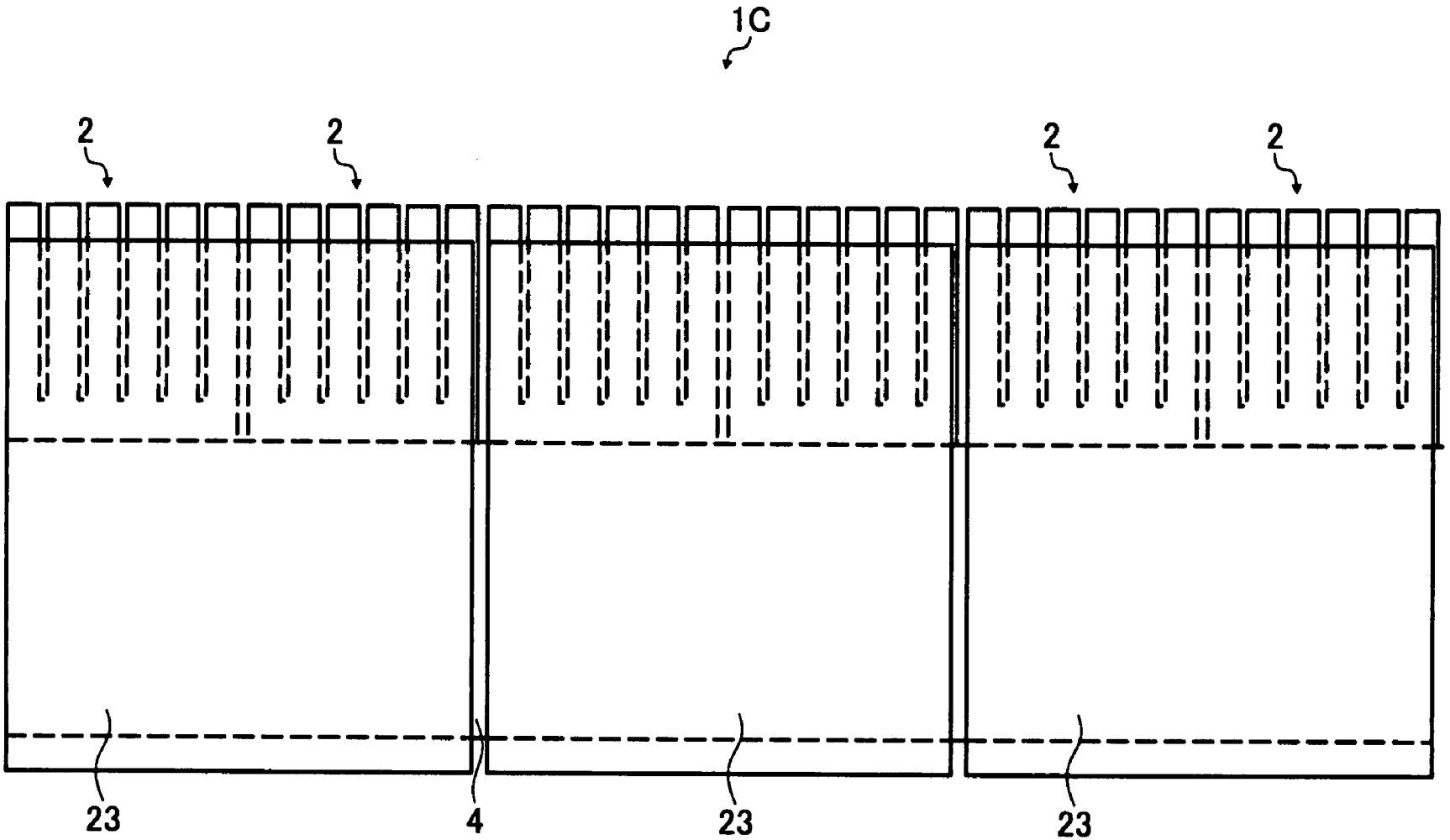
FIG. 11 is a schematic view of a piezoelectric actuator according to yet another exemplary embodiment.
Figure 12:
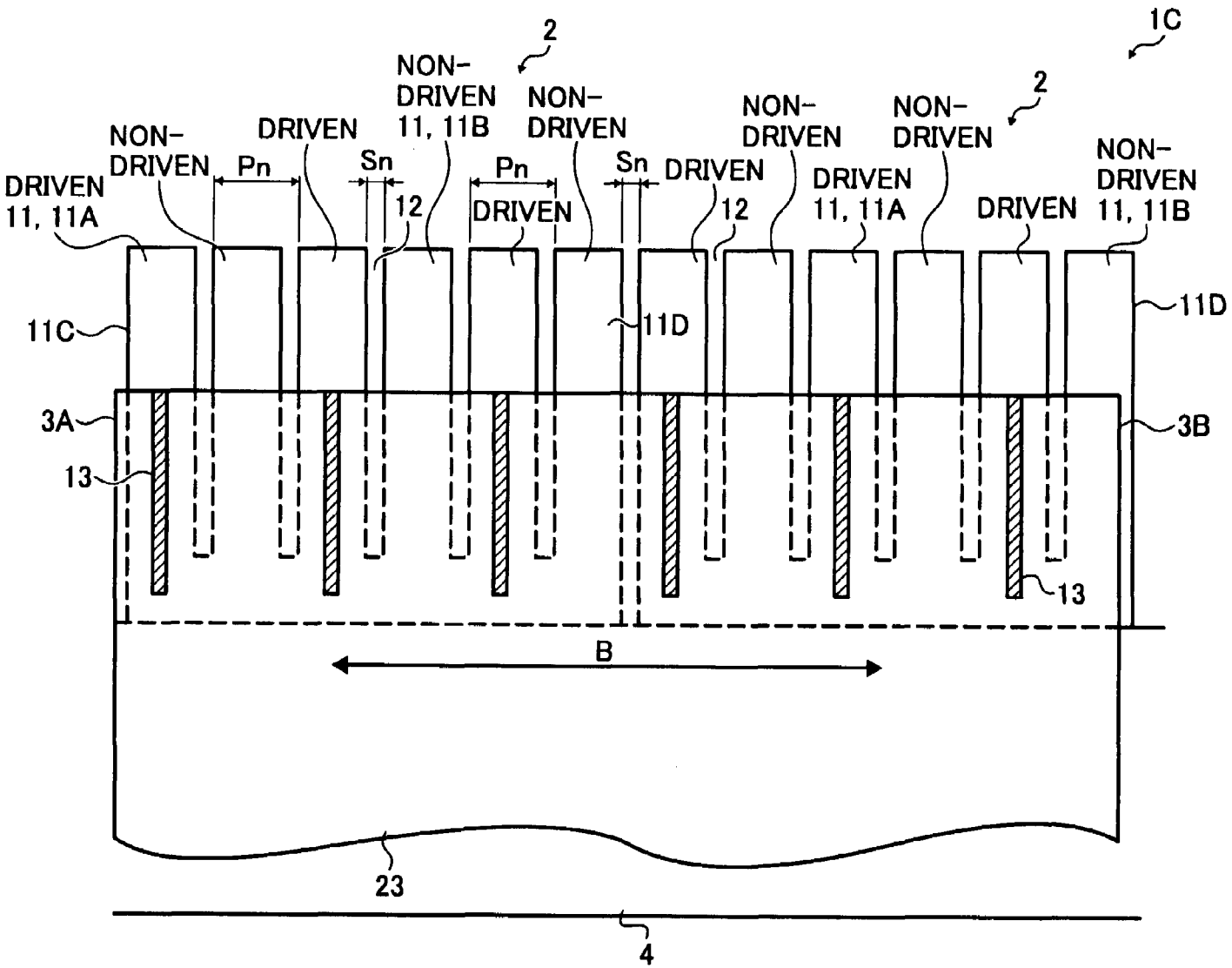
FIG. 12 is an enlarged view of the piezoelectric actuator shown in FIG. 11.

Referring to FIGS. 11 and 12, the following describes a piezoelectric actuator 1C according to yet another exemplary embodiment. FIG. 11 is a schematic view of the piezoelectric actuator 1C. FIG. 12 is an enlarged view of the piezoelectric actuator 1C.

As illustrated in FIG. 11, the piezoelectric actuator 1C includes electric supply members 23. One electric supply member 23 is shared by two piezoelectric elements 2. As illustrated in FIG. 12, when two piezoelectric elements 2 are combined, the end 3A of the electric supply member 23 for the endmost driven piezoelectric element column 11A to which the electrode 13 is connected is positioned outwardly from the outer end 11C of the driven piezoelectric element column 11A in the direction B in which the piezoelectric element columns 11 are arranged, while the end 3B of the electric supply member 23 for the endmost non-driven piezoelectric element column 11B to which the electrode 13 is not connected is positioned inwardly from the outer end 11D of the non-driven piezoelectric element column 11B. Therefore, adjacent electric supply members 23 do not overlap. The other elements of the piezoelectric actuator 1C are identical to the piezoelectric actuator 1A depicted in FIG. 6.

Since two or more piezoelectric elements 2 share one electric supply member 23, advantageous effects provided by the piezoelectric actuator 1A depicted in FIG. 6 may be obtained, and the number of components may be reduced. Further, according to the above-described non-limiting exemplary embodiment, one electric supply member 23 supplies electricity to two piezoelectric elements 2. However, when a plurality of electric supply members 23 is used, one electric supply member 23 may supply electricity to three or more piezoelectric elements 2.

Figure 13:
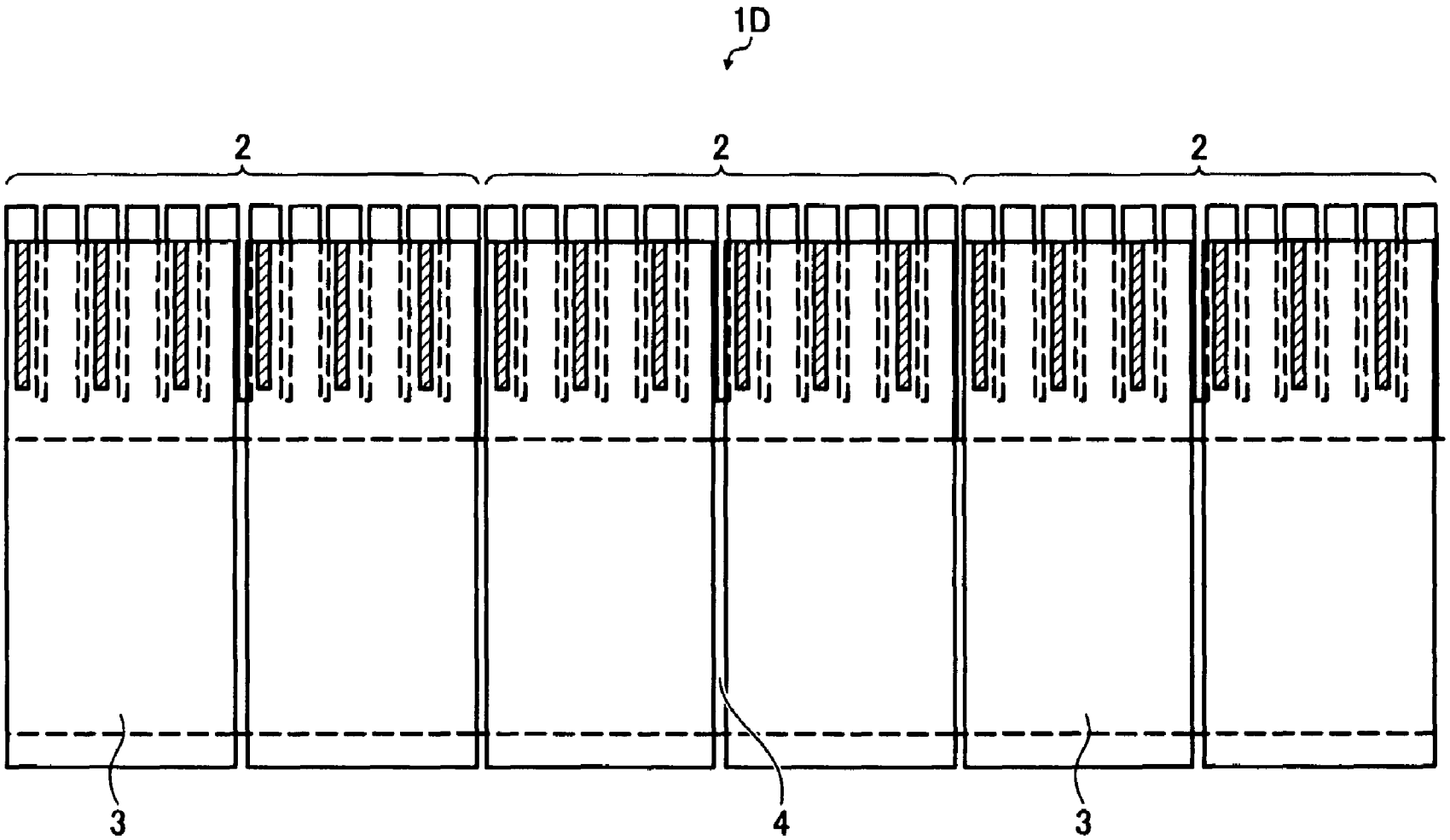
FIG. 13 is a schematic view of a piezoelectric actuator according to still yet another exemplary embodiment.
Figure 14:
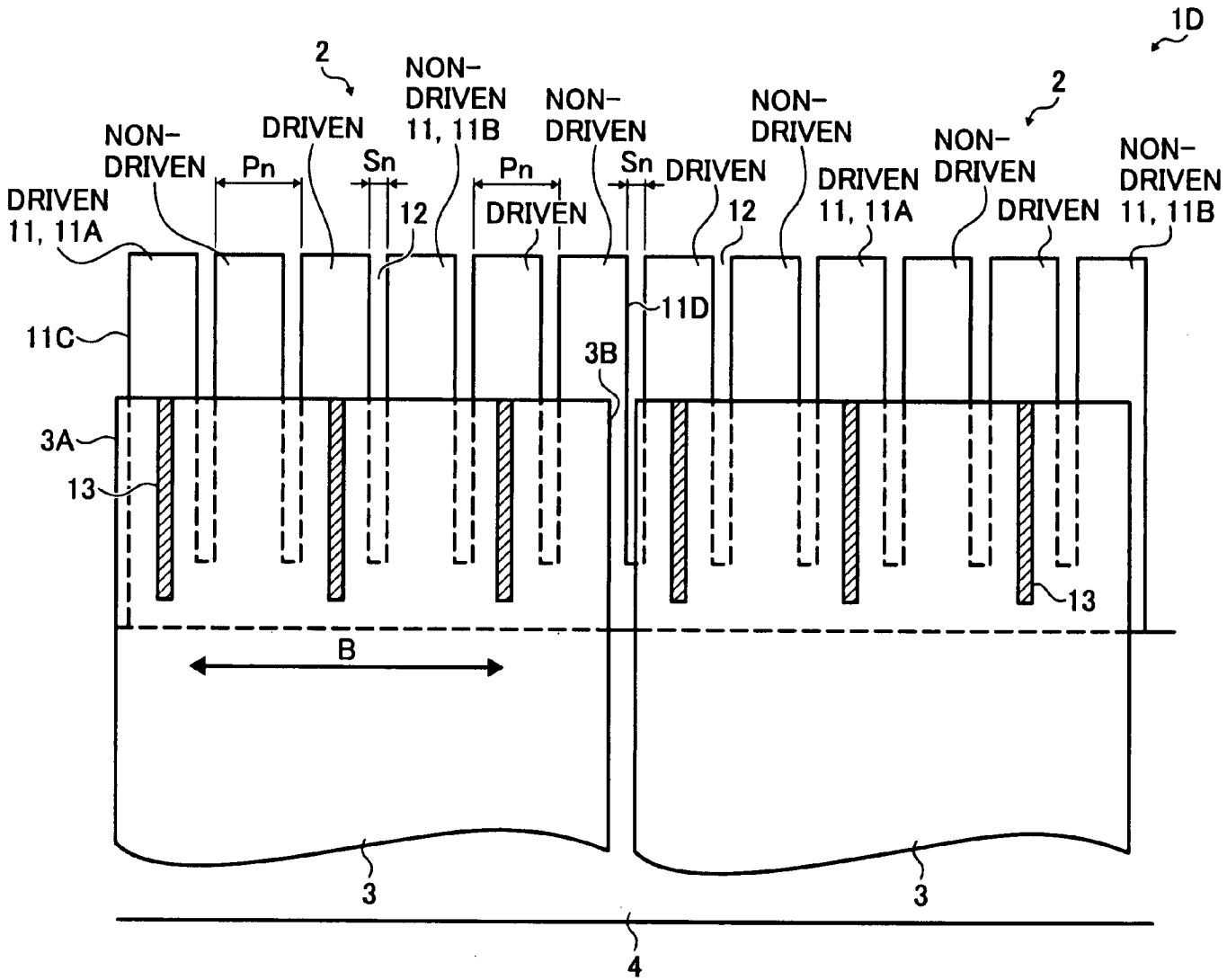
FIG. 14 is an enlarged view of the piezoelectric actuator shown in FIG. 13.

Referring to FIGS. 13 and 14, the following describes a piezoelectric actuator 1D according to yet another exemplary embodiment. FIG. 13 is a schematic view of the piezoelectric actuator 1D. FIG. 14 is an enlarged view of the piezoelectric actuator 1D.

The distinctive feature of the present embodiment is that, instead of just one electric supply member being connected to one piezoelectric element, a plurality of electric supply members is connected to one piezoelectric element. This arrangement has several advantages, which will be described later.

For example, two electric supply members 3 are connected to one piezoelectric element 2 as illustrated in FIG. 13. As illustrated in FIG. 14, one end 3A of one of the electric supply members 3 is positioned outwardly from the outer end 11C of the driven piezoelectric element column 11A to which the electrode 13 is connected in the direction B in which the piezoelectric element columns 11 are arranged, while another end 3B of the electric supply member 3 is positioned inwardly from the outer end 11D of the non-driven piezoelectric element column 11B to which the electrode 13 is not connected in the direction B. Thus, adjacent electric supply members 3 do not overlap. The other elements of the piezoelectric actuator 1D are identical to the piezoelectric actuator 1A depicted in FIG. 6.

As noted above, this arrangement has several advantages. For example, it should be noted that processing accuracy of a slit or groove processing machine (e.g., a dicer) determines the pitch of the piezoelectric element columns 11. Thus, typically, for example, an accuracy of plus or minus 3 μm for a length of 500 mm may be obtained. For most purposes, that is good enough. However, electrode 13 pitch error accumulates as the width of the electric supply member 3 increases. Therefore, as the width of the piezoelectric element 2 increases, so too does the difference between the pitch of alignment of the electrodes 13 and the pitch of alignment of the driven piezoelectric element columns 11A, and this misalignment resulting from accumulated error can cause contact failure when there is only one electric supply member for multiple piezoelectric element columns, leaving without power some columns that should be driven. Connecting the plurality of electric supply members 3 to one piezoelectric element 2 as in the present embodiment prevents such contact failure even when this misalignment occurs.

The piezoelectric actuator 11D includes an even number of piezoelectric element columns 11 provided via slit grooves 12 at a predetermined pitch, a plurality of piezoelectric elements 2 disposed in a row, and a plurality of electric supply members 3 having the electrodes 13 disposed for the alternate driven piezoelectric element columns 11A of the piezoelectric elements 2. One end 3A of the electric supply member 3 is positioned outwardly from the outer end 11C of the driven piezoelectric element column 11A to which the electrode 13 is connected in the direction B in which the piezoelectric element columns 11 are arranged, while another end 3B of the electric supply member 3 is positioned inwardly from the outer end 11D of the non-driven piezoelectric element column 11B to which the electrode is not connected in the direction B in which the piezoelectric element columns 11 are arranged. Therefore, adjacent electric supply members 3 do not overlap. The piezoelectric actuator 11D includes one type of the piezoelectric element 2 in which one endmost piezoelectric element column 11 of the piezoelectric element 2 may be the driven piezoelectric element column 11A, while another endmost piezoelectric element column 11 of the piezoelectric element 2 may be the non-driven piezoelectric element column 11B. Namely, the non-driven piezoelectric element column 11B provided at an end of one of adjacent piezoelectric elements 2 is adjacent to the driven piezoelectric element column 11A provided at an end of another one of adjacent piezoelectric elements 2. Thus, the plurality of electric supply members 3 may be connected to each other without interference. Therefore, the long, reliable piezoelectric actuator 11D may be obtained at a low cost.

Figure 15:
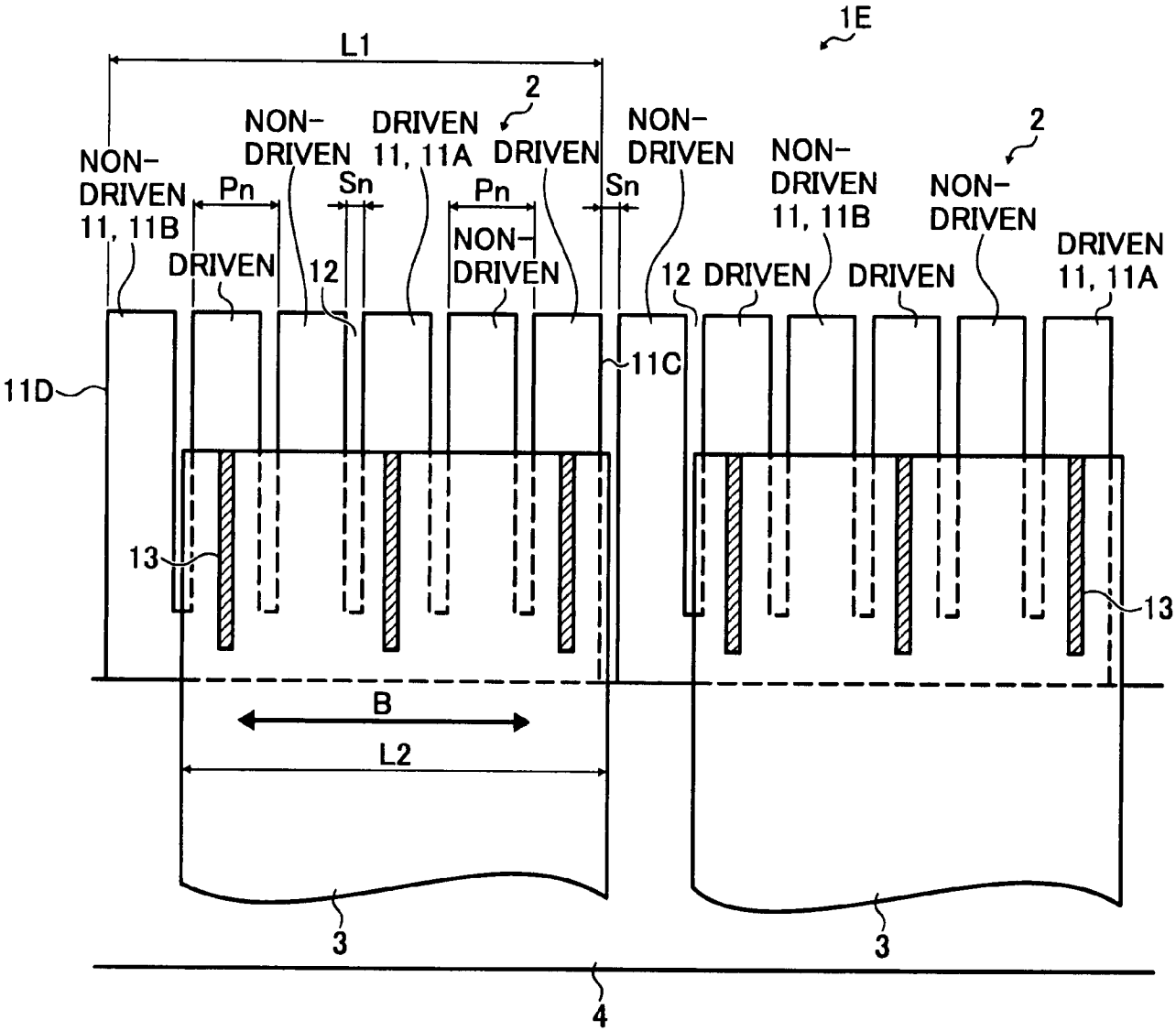
FIG. 15 is an enlarged view of a piezoelectric actuator according to still yet another and further exemplary embodiment.

Referring to FIG. 15, the following describes a piezoelectric actuator 1E according to yet another exemplary embodiment. FIG. 15 is an enlarged view of the piezoelectric actuator 1E.

A width L2 of the electric supply member 3 in the direction B in which the piezoelectric element columns 11 are arranged is smaller than a width L1 of the piezoelectric element 2 in the direction B. Accordingly, two adjacent electric supply members 3 do not overlap, and the electric supply members 3 need not be precisely positioned, thereby improving workability of connection of the electric supply members 3.

The piezoelectric actuator 1E includes an even number of piezoelectric element columns 11 provided via slit grooves 12 at a predetermined pitch, a plurality of piezoelectric elements 2 disposed in a row, and a plurality of electric supply members 3 having electrodes 13 disposed for the alternate driven piezoelectric element columns 11A of the piezoelectric element 2. Since the piezoelectric actuator 1E includes one type of the piezoelectric element 2 in which the width L2 of the electric supply member 3 in the direction 3 in which the piezoelectric element columns 11 are arranged is smaller than the width L1 of the piezoelectric element 2 in the direction B, the plurality of electric supply members 3 may be connected to each other without interference. Therefore, the long, reliable piezoelectric actuator 1E may be obtained at a low cost.

For example, one electric supply member 3 may be connected to a plurality of piezoelectric elements 2, or a plurality of electric supply members 3 may be connected to one piezoelectric element 2.

According to the above-described exemplary embodiments, since the image forming apparatus such as the image forming apparatus 200 depicted in FIG. 1 includes the liquid discharging head such as the liquid discharging head 100 depicted in FIG. 2, image formation may be performed at high speed by using the reliable liquid discharging head at a low cost. Further, the liquid discharging head or the liquid discharging device (e.g., the image forming device 202 depicted in FIG. 1) including the liquid discharging head may perform reliable liquid discharge at a low cost.

Although in the above-described exemplary embodiments the liquid discharging device is adapted to the image forming apparatus functioning as a printer, the liquid discharging device according to the above-described exemplary embodiments is not limited thereto and may be adapted to an image forming apparatus functioning as a copying machine, a facsimile, or a multi-function printer having two or more of copying, printing, and facsimile functions. Similarly, the above-described exemplary embodiments may be adapted to an image forming apparatus using a recording liquid other than ink, fixing liquid, and/or the like and to a liquid discharging device for discharging various liquids.

According to the above-described exemplary embodiments, the image forming apparatus includes an apparatus for forming an image by discharging liquid. The recording medium on which the image forming apparatus forms an image includes, but is not limited to, paper, string, fiber, cloth, leather, metal, plastic, glass, wood, ceramics, and/or the like. The images formed by the image forming apparatus may include a character, a letter, graphics, a pattern, and/or the like. The liquid with which the image forming apparatus forms an image is not limited to ink but includes any fluid and any substance that becomes fluid when discharged from the liquid discharging head. The liquid discharging head may discharge liquid not forming an image as well as liquid forming an image. Further, the liquid discharging device is not limited to a device for forming an image but includes any device for discharging liquid.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese patent application Nos. 2006-325905 filed on Dec. 1, 2006 and 2007-267027 filed on Oct. 12, 2007 in the Japan Patent Office, the entire contents of each of which are hereby incorporated herein by reference.

What is claimed is:

1. A liquid discharging head for discharging liquid, the liquid discharging head comprising:

a piezoelectric actuator, comprising:

a plurality of piezoelectric elements provided in a row, the plurality of piezoelectric elements comprising an even number of piezoelectric element columns provided via a groove at a predetermined pitch; and a plurality of electric supply members configured to supply electricity to the plurality of piezoelectric elements, the plurality of electric supply members comprising electrodes disposed for the alternate piezoelectric element columns of the respective piezoelectric elements, wherein one end of the electric supply member for an endmost driven piezoelectric element column to which the electrode is connected is positioned outwardly from an outer end of the driven piezoelectric element column in a direction in which the piezoelectric element columns are aligned, while another end of the electric supply member for an endmost non-driven piezoelectric element column to which the electrode is not connected is positioned inwardly from an outer end of the non-driven piezoelectric element column in the direction in which the piezoelectric element columns are aligned, in a manner that adjacent electric supply members do not overlap.

2. The liquid discharging head according to claim 1, wherein at least two piezoelectric elements are provided for one electric supply member.

3. The liquid discharging head according to claim 1, wherein an amount of outward deviation of one end of the electric supply member from the outer end of the endmost driven piezoelectric element column is not greater than one pitch plus one groove width.

4. The liquid discharging head according to claim 1, wherein an amount of inward deviation of another end of the electric supply member from the outer end of the endmost non-driven piezoelectric element column is not greater than one pitch.

5. The liquid discharging head according to claim 1, wherein the piezoelectric element columns to which the electrodes are connected are provided at a common pitch.

6. The liquid discharging head according to claim 1, wherein one piezoelectric element is provided for a plurality of electric supply members.

7. An image forming apparatus, comprising:

a liquid discharging head configured to discharge liquid, the liquid discharging head comprising:

a piezoelectric actuator comprising:

a plurality of piezoelectric elements provided in a row, the plurality of piezoelectric elements comprising an even number of piezoelectric element columns provided via a groove at a predetermined pitch; and a plurality of electric supply members configured to supply electricity to the plurality of piezoelectric elements, the plurality of electric supply members comprising electrodes disposed for the alternate piezoelectric element columns of the respective piezoelectric elements, wherein one end of the electric supply member for an endmost driven piezoelectric element column to which the electrode is connected is positioned outwardly from an outer end of the driven piezoelectric element column in a direction in which the piezoelectric element columns are aligned, while another end of the electric supply member for an endmost non-driven piezoelectric element column to which the electrode is not connected is positioned inwardly from an outer end of the non-driven piezoelectric element column in the direction in which the piezoelectric element columns are aligned, in a manner that adjacent electric supply members do not overlap.

* * * * *